US010476223B2

(12) United States Patent
Miyakawa

(10) Patent No.: US 10,476,223 B2
(45) **Date of Patent: *Nov. 12, 2019**

(54) PRODUCTION METHOD FOR TERMINAL, AND TERMINAL

(71) Applicant: YAZAKI CORPORATION, Tokyo (JP)

(72) Inventor: Daisuke Miyakawa, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 96 days.

This patent is subject to a terminal disclaimer.

(21) Appl. No.: 15/793,060

(22) Filed: Oct. 25, 2017

(65) Prior Publication Data

US 2018/0048107 A1 Feb. 15, 2018

Related U.S. Application Data

(63) Continuation of application No. 15/152,626, filed on May 12, 2016, now Pat. No. 9,843,151, which is a continuation of application No. PCT/JP2014/082628, filed on Dec. 10, 2014.

(30) Foreign Application Priority Data

Dec. 12, 2013 (JP) ..... 2013-256662

(51) Int. Cl.

| | |
|---|---|
| ***H01R 13/03*** | (2006.01) |
| ***H01R 43/16*** | (2006.01) |
| ***H01R 4/18*** | (2006.01) |
| ***H01R 13/187*** | (2006.01) |
| ***H01R 43/04*** | (2006.01) |

(52) U.S. Cl.
CPC ..... *H01R 43/16* (2013.01); *H01R 4/183* (2013.01); *H01R 13/187* (2013.01); *H01R 43/04* (2013.01); *H01R 4/185* (2013.01)

(58) Field of Classification Search
USPC ..... 439/886, 887, 852
See application file for complete search history.

(56) References Cited

U.S. PATENT DOCUMENTS 4,384,926 A * 5/1983 Wagner ..... C25D 5/02 204/224 R
6,024,612 A * 2/2000 Myer ..... H01R 13/113 439/744

(Continued)

OTHER PUBLICATIONS

An office action dated Dec. 18, 2017 in a counterpart Chinese patent application.

*Primary Examiner* — Hien D Vu
(74) *Attorney, Agent, or Firm* — Metrolex IP Law Group, PLLC

(57) ABSTRACT

A production method for a terminal includes: a first pressing step for pressing a parent material plate made of a conductive metal and punching out a prescribed shape; a second pressing step following the first pressing step, for bending the plate of prescribed shape, and forming a terminal provided with a box part onto the front surface of which opens a terminal insertion port into which a partner terminal is inserted, and a spring contact part arranged inside the box part; and a plating step following the second pressing step, for plating at least the spring contact part with a conductive metal.

3 Claims, 7 Drawing Sheets

(56) References Cited

U.S. PATENT DOCUMENTS 6,244,910 B1 * 6/2001 Grubbs ..... H01R 13/113
439/595
6,264,509 B1 * 7/2001 Kwang ..... H01R 13/113
439/852

* cited by examiner

PRODUCTION METHOD FOR TERMINAL, AND TERMINAL

CROSS REFERENCE TO RELATED APPLICATIONS

This application is a continuation of application Ser. No. 15/152,626, filed on May 12, 2016, which is based upon International Application No. PCT/JP2014/082628, filed on Dec. 10, 2014, which claims priority based on the Article 8 of Patent Cooperation Treaty from prior Japanese Patent Application No. 2013-256662, filed on Dec. 12, 2013, the entire contents of which are incorporated herein by reference.

TECHNICAL FIELD

The present invention relates to a production method for a terminal, by which a spring contact part in a box part is plated partially, and the terminal manufactured by the production method.

BACKGROUND

A terminal having a spring contact part in a box part is capable of securing reliable and stable spring contact pressure between this terminal and a partner terminal since the spring contact part is surrounded by the rigid box part. Moreover, if the spring contact part is plated with a conductive metal, then the terminal has an advantage such that the electrical resistance of a terminal's portion in contact with the partner terminal can be reduced.

The production method for such a terminal as a conventional example has been performed by the following procedures of: pressing a conductive parent material plate and punching out a prescribed shape (punch-out/pressing step); plating a portion of the punched plate of the prescribed shape, which will constitute the spring contact part (plating step); and pressing the plate of the prescribed shape and bending it to a prescribed form (bending/pressing step). The above-mentioned plating step is disclosed in PTL 1 (JP 2004-241728 A).

SUMMARY

In the terminal production method of the conventional example, however, since the plating step is interposed between the punch-out step as one pressing step and the bending step as another pressing step, there are problems that the production lasts for a long time and causes cost increase since it requires troublesome settings for all different kinds of manufacturing steps and transportations of products among these steps.

In order to solve the above-mentioned problem, an object of the present invention is to provide a production method for a terminal where a spring contact part in a box part is to be plated, which method brings about shortening of manufacturing time, low manufacturing cost, etc., and to provide the terminal manufactured by the production method.

A production method for a terminal according to a first aspect of the present invention includes: a first pressing step for pressing a parent material plate made of a conductive metal and punching out a prescribed shape; a second pressing step following the first pressing step, for bending the plate of prescribed shape and forming the terminal provided with a box part onto the front surface of which opens a terminal insertion port into which a partner terminal is inserted, and a spring contact part arranged inside the box part; and a plating step following the second pressing step, for plating at least the spring contact part with a conductive metal.

The plating step may be to allow a nozzle to enter the box part through the terminal insertion port and allow the entered nozzle to jet plating liquid, thereby plating at least the spring contact part. Or again, the plating step may be to allow a nozzle to jet plating liquid through the use of a plating-utility opening provided in the box part, thereby plating at least the spring contact part. Then, the plating-utility opening may be arranged in a portion of a terminal contact part of the box part, the portion facing the spring contact part, and the plating step may be to allow the nozzle to face the spring contact part through the plating-utility opening and allow the nozzle to jet the plating liquid to at least the spring contact part. Or again, the plating-utility opening may be arranged in a portion of the box part, the portion being different from a terminal contact part, and the plating step may be to allow the nozzle to enter through the plating-utility opening and allow the nozzle to jet the plating liquid to at least the spring contact part.

A terminal according to a second aspect of the present invention, which is to be formed by pressing a parent material plate made of a conductive metal to punch out a prescribed shape and bending the plate of prescribed shape, includes: a box part onto the front surface of which opens a terminal insertion port into which a partner terminal is inserted; and a spring contact part arranged inside the box part, wherein at least the spring contact part inside the box part is plated with a conductive metal.

In the terminal, at least the spring contact part may be plated by allowing a nozzle to enter the box part through the terminal insertion port and allowing the entered nozzle to jet plating liquid. Or again, the box part may be provided with a plating-utility opening, and at least the spring contact part may be plated by allowing a nozzle to jet plating liquid with use of the plating-utility opening. The plating-utility opening may be arranged in a portion of a terminal contact part of the box part, the portion facing the spring contact part. Or again, the plating-utility opening may be arranged in a portion of the box part, the portion being different from a terminal contact part.

With respective aspects of the present invention, the punch-out step and the bending step are executed in the form of sequential pressing steps and thereafter, the plating step as a different kind of step is executed. Therefore, the setting operations for respective steps and the transportations of products among these steps are facilitated in whole, thereby allowing shortening of manufacturing time, reduction of manufacturing cost, etc.

DESCRIPTION OF EMBODIMENTS

Embodiments will be described with reference to drawings.

First Embodiment

Figure 1A:
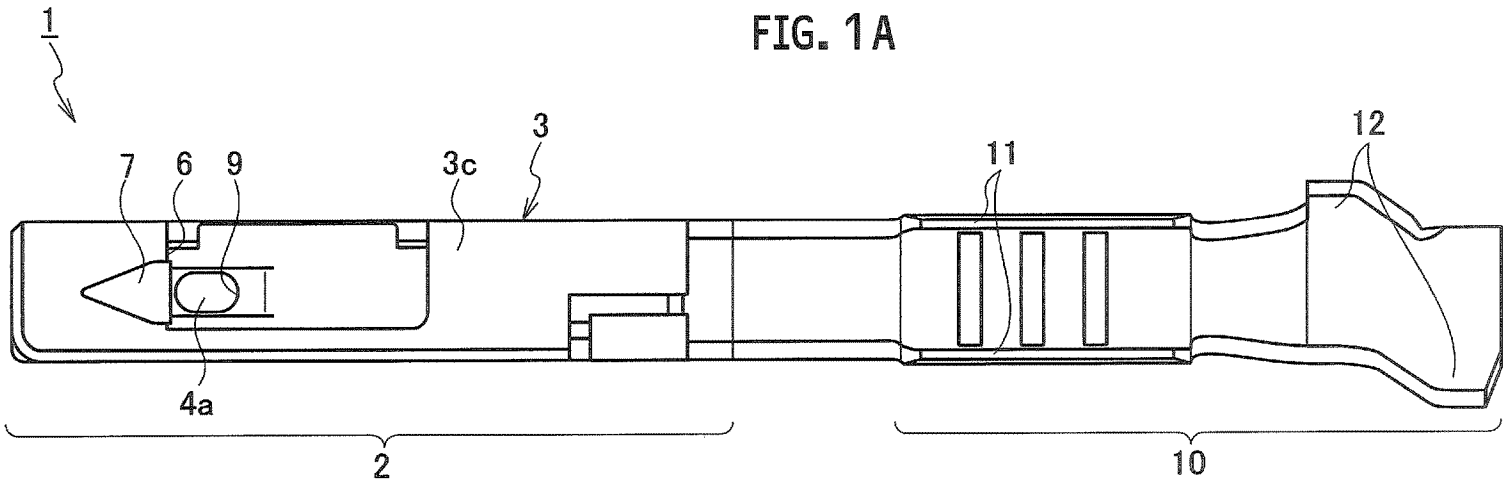
FIG. 1A is a plan view of a terminal according to a first embodiment.
Figure 1B:
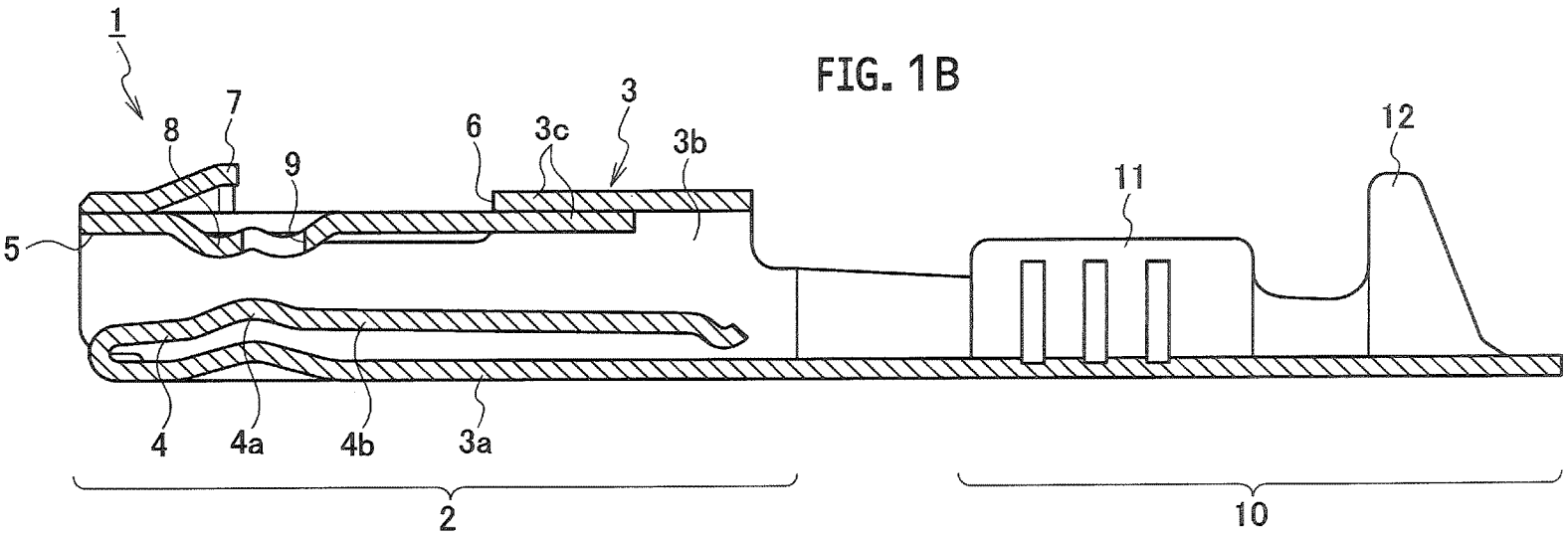
FIG. 1B is a sectional view of the terminal according to the first embodiment.
Figure 2:
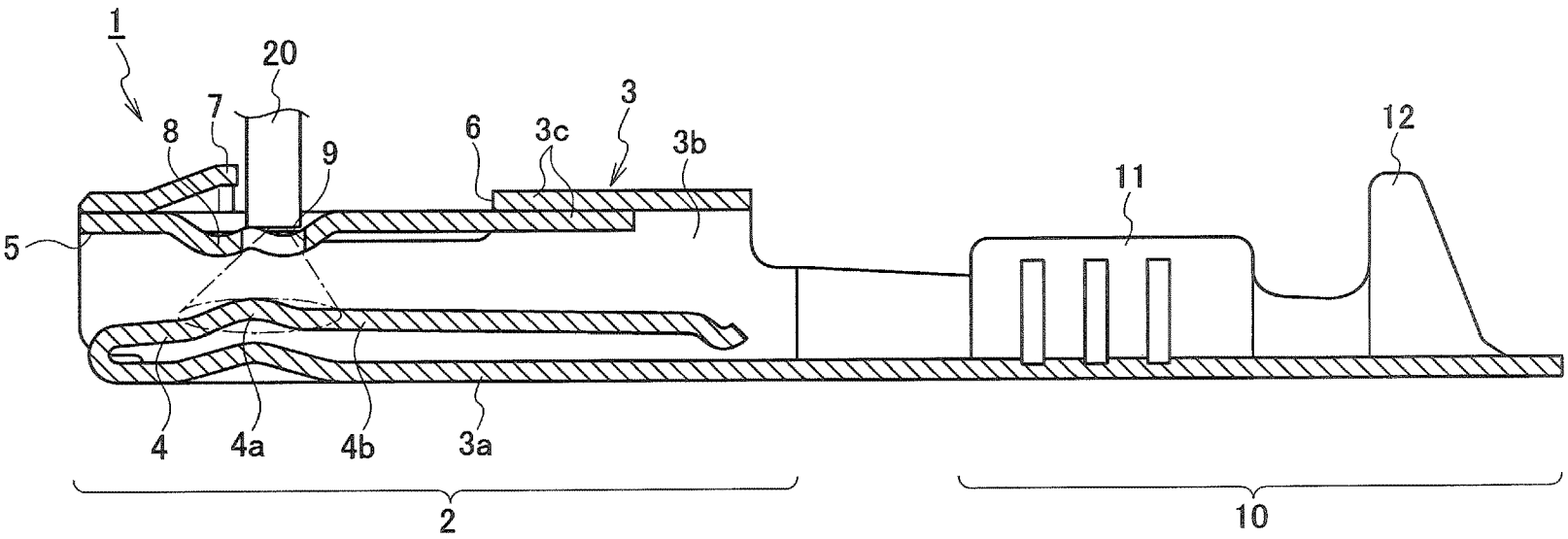
FIG. 2 is a sectional view illustrating a condition that gold-plating liquid is jetted to a spring contact part of the terminal according to the first embodiment.

FIGS. 1 to 3 illustrate a first embodiment. As illustrated in FIG. 1, a terminal 1 according to the first embodiment includes a partner-terminal connecting part 2 and a wire connecting part 10. The partner-terminal connecting part 2 includes a box part 3 having a rectangular-cylindrical shape and a spring contact part 4 arranged in the box part 3. The box part 3 includes a bottom wall 3*a*, a pair of sidewalls 3*b* formed by folding both sides of the bottom wall 3*a*, and a top wall 3*c* formed by folding respective upper ends of the sidewalls 3*b* on both sides. Onto the front face of the box part 3, there is formed a terminal insertion port 5 into which a partner terminal (not illustrated) can be inserted. The top wall 3*c* includes two pieces of overlapped wall plates. An upper wall plate of the top wall 3*c* is provided with a large cutout 6 and a lance locking projection 7 utilizing a rear face of the cutout 6 as a locking face. A lower wall plate of the top wall 3*c* is provided with a terminal contact part 8 projecting to an interior side of the box part 3. The terminal contact part 8 is shaped in a waveform having irregularities, in which downward convex portions are located at the lowermost positions in a lower face of the top wall 3*a*. The terminal contact part 8 is located in a position facing an indent part 4*a*.

The spring contact part 4 is formed by folding back a front end of the bottom wall 3*a* inside the box part 3 in a greatly-curved manner. The spring contact part 4 is displaced vertically due to flexural deformation etc. of such a curved portion of the spring contact part 4. The spring contact part 4 is provided with the indent part 4*a* which projects upward into a semispherical shape. This indent part 4*a* is located at the uppermost position in the spring contact part 4. The partner terminal (not illustrated) inserted into the box part 3 comes into contact with the spring contact part 4 and the terminal contact part 8 due to flexural returning force of the spring contact part 4. More specifically, a partner terminal's portion on the side of the spring contact part 4 comes into contact with the indent part 4*a*. The spring contact part 4 has a spring reinforced part 4*b* extending from the indent part 4*a*. The spring reinforced part 4*b* has a leading end arranged close to the bottom wall 3*a*. When the spring contact part 4 is flexurally deformed by the partner terminal (not illustrated) inserted into the box part 3, the leading end of the spring reinforced part 4*b* abuts on the bottom wall 3*a*. Then, under a condition of further flexural deformation of the spring contact part 4, the spring force is further enhanced by the addition of flexural deforming force of the spring reinforced part 4*b*. In this way, the terminal is adapted so as to enable large spring contact force to be secured between the terminal and the partner terminal.

In a portion of the terminal contact part 8, which corresponds to a position facing an upper position of the spring contact part 4, more specifically, in a position facing the indent part 4*a*, there is provided a plating-utility opening 9. The plating-utility opening 9 has an opening dimension smaller than the outer diameter size of a later-mentioned nozzle 20.

The upper face of the spring contact part 4 including the indent part 4*a* and the circumference of the plating-utility opening 9 (the inner circumferential face of the plating-utility opening 9 and the lower face of the terminal contact part 8) are plated with gold (not illustrated) as a conductive metal.

The wire connecting part 10 includes a pair of core-wire crimping parts 11 for crimping a core wire of an electrical wire (not illustrated) and a pair of sheath crimping parts 12 for crimping the electrical wire through an insulating sheath. Since the electrical wire is crimped by the pair of core-wire crimping parts 11 and the pair of sheath crimping parts 12, the terminal 1 is fixed to the electrical wire under an electrical connecting state.

Next, the production method for the terminal 1 will be described. First, it is performed to press a parent plate (not illustrated) made of a conductive metal and punch out a prescribed shape (unfolded figure of the terminal 1), thereby manufacturing a plate (not illustrated) of prescribed shape (first pressing step).

Next, the plate punched in the prescribed shape is pressed in prescribed procedures and bent to prescribed directions to manufacture the terminal 1 (second pressing step). Specifically, there is formed the terminal 1 which includes: the partner-terminal connecting part 2 provided with the box part 3 onto the front surface of which opens the terminal insertion port 5, and the spring contact part 4 arranged inside the box part 3; and the wire connecting part 10.

Subsequent to the second pressing step, a plating step is performed. The plating step includes a gold-plating jetting process and a calcination process. The gold-plating jetting process employs an ink-jet type nozzle 20 through which gold-plating liquid is jetted. In the gold-plating jetting process, as illustrated in FIG. 2, the nozzle 20 is arranged so as to abut on the outside of the plating-utility opening 9, and the gold-plating liquid is jetted from a tip face of the nozzle 20 downwardly. Consequently, gold plating adheres to the top face of the spring contact part 4 around the indent part 4*a*. Additionally, the gold plating adheres to the circumference of the plating-utility opening 9 (the inner circumferential face of the plating-utility opening 9 and the lower face of the terminal contact part 9) as well. Subsequently, the calcination process is executed to secure its adhesion to an undercoat. Examples of calcination means include calcination by heat, plasma calcination, and laser calcination. Alternatively, the calcination process may be replaced by a cleaning process using cleaning liquid.

As mentioned above, there are executed: the first pressing step for pressing the parent material plate made of the conductive metal and punch out the prescribed shape; the second pressing step following the first pressing step, for bending the plate punched in the prescribed shape, and forming the terminal 1 provided with the box part 3 onto the front surface of which opens the terminal insertion port 5 into which a partner terminal is inserted, and the spring contact part 4 arranged inside the box part 3; and the plating step following the second pressing step, for plating at least the spring contact part 4 with gold as a conductive metal. Thus, the punch-out step and the bending step are executed in the form of sequential pressing steps and thereafter, the plating step as a different kind of step is executed. Therefore, the setting operations for respective steps and the transportations of products among these steps are facilitated in whole, thereby allowing shortening of manufacturing time, reduction of manufacturing cost, etc.

As the plating step can be executed at any time as long as it follows the bending step, it is possible to execute the plating step even during the manufacturing process of a single terminal or even during the manufacturing process of a wire harness. Even when there exist terminals 1 to be plated and other terminals 1 to be unplated in case of executing the plating step during the manufacturing process of a wire harness, one sort of management of the item numbers of components is applicable until the manufacturing process of individual terminals, so that the management is facilitated.

The box part 3 is provided with the plating-utility opening 9. With use of the plating-utility opening 9, the gold-plating liquid is jetted from the nozzle 20, so that the gold plating is applied to at least the spring contact part 4. Accordingly, the gold-plating jetting process can be executed after the bending step with ease.

Especially, the plating-utility opening 9 is located in a portion of the terminal contact part 8 of the box part 3, the portion facing the spring contact part 4. Thus, since the gold-plating liquid can be jetted by the nozzle 20 arranged outside the box part 3, the workability in the gold-plating jetting process is excellent. In connection, if the plating-utility opening 9 is formed larger than the outer diameter size of the nozzle 20, it may be carried out to insert the tip part of the nozzle 20 into the box part 3 through the plating-utility opening 9 and allow the nozzle 20 to jet the gold-plating liquid.

The plating-utility opening 9 is located in the portion of the terminal contact part 8 of the box part 3, the portion facing the spring contact part 4. Accordingly, the plating-utility opening 9 may be formed with an opening dimension smaller than the outer diameter size of the nozzle 20 and therefore, it is possible to suppress a strength degradation of the box part 3 to the utmost, in comparison with a box part where the plating-utility opening 9 is not provided.

Figure 3B:
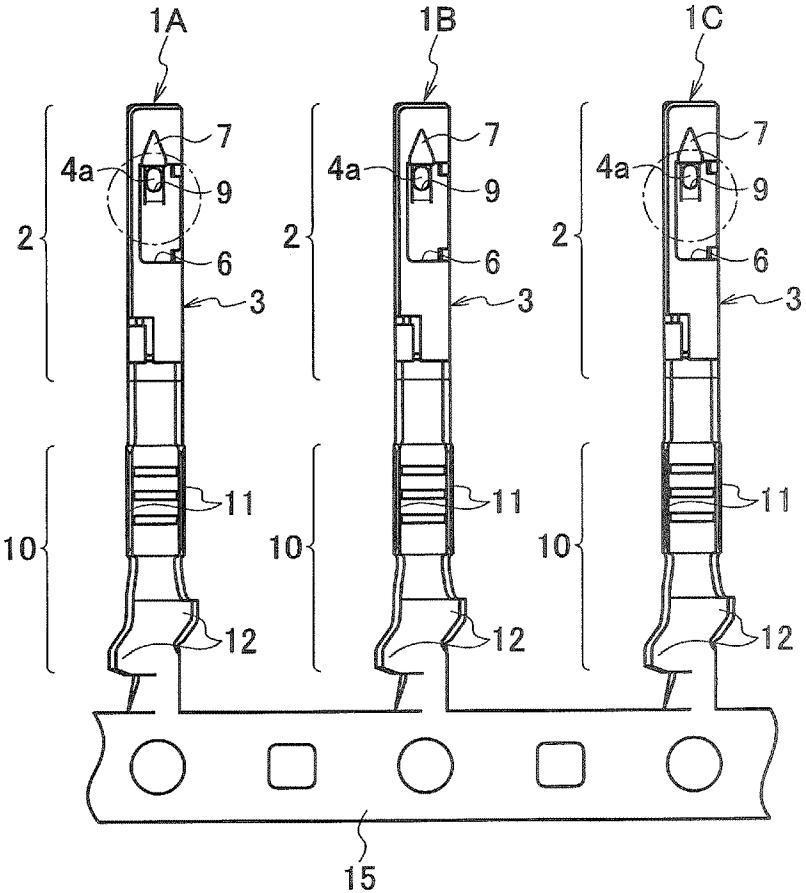
FIG. 3B is a plan view illustrating a case of performing calcinations to the terminals obtained by selectively performing the gold plating to the terminals each connected to the carry part.
Figure 3A:
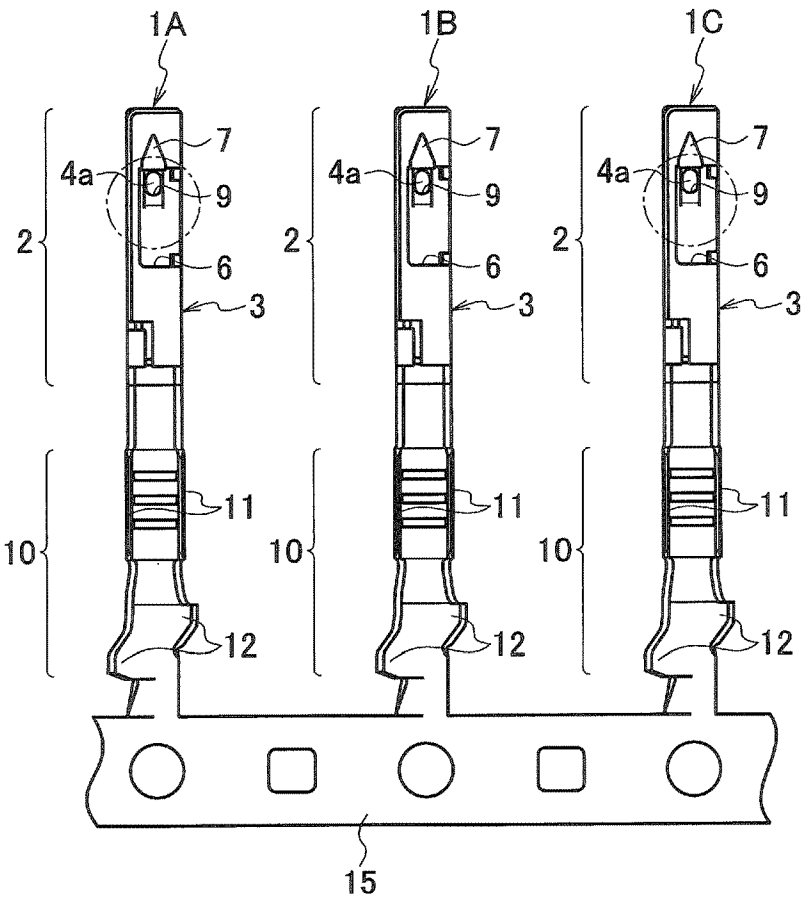
FIG. 3A is a plan view illustrating a case of selectively performing gold plating to a plurality of terminals each connected to a carry part.

FIGS. 3A and 3B illustrate an application of the first embodiment. As illustrated in FIG. 3A, terminals 1A, 1B, and 1C on completion of the punch-out step and the bending step are connected to each other via a carry part 15. In a case that the terminals 1A, 1C to be plated and the terminal 1B to be unplated are present, the gold-plating jetting process is executed selectively. Subsequently, as illustrated in FIG. 3B, the calcination process is also executed to only the terminals 1A, 1C on completion of the gold-plating jetting process and thereafter, these terminals are transferred to a wire crimping step.

As the gold plating treatment is performed with use of the nozzle 20, it is possible to freely select the terminals 1A, 1C to be plated and the terminal 1B to be unplated, like this application. Thus, it is also possible to cope with such a requirement of mixing the plated terminals 1A, 1C with the unplated terminal 1B.

Second Embodiment

Figure 4A:
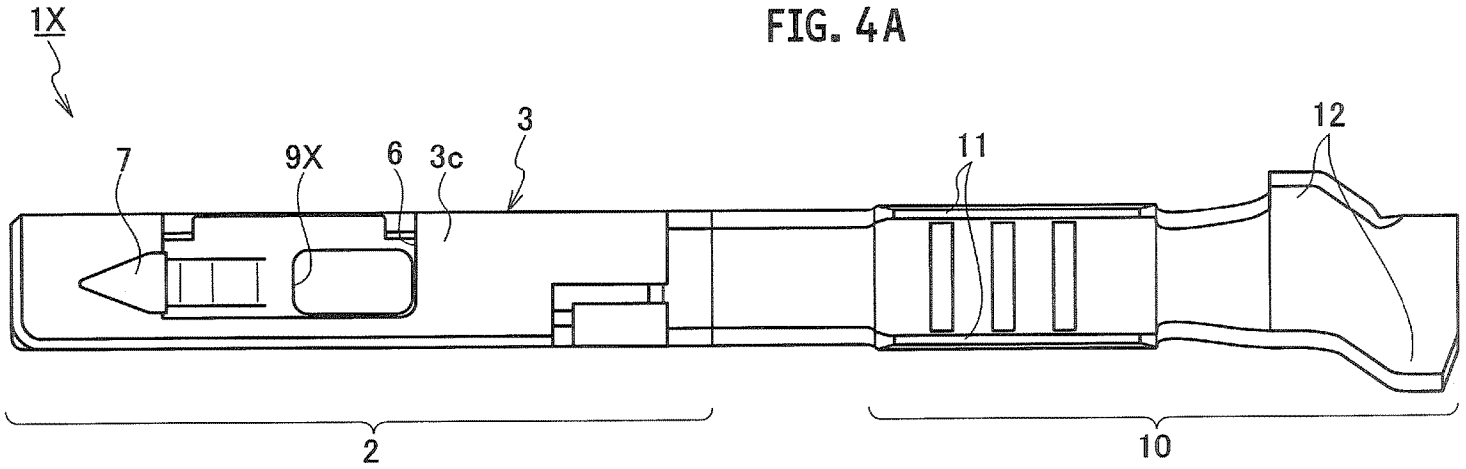
FIG. 4A is a plan view of a terminal according to a second embodiment.
Figure 4B:
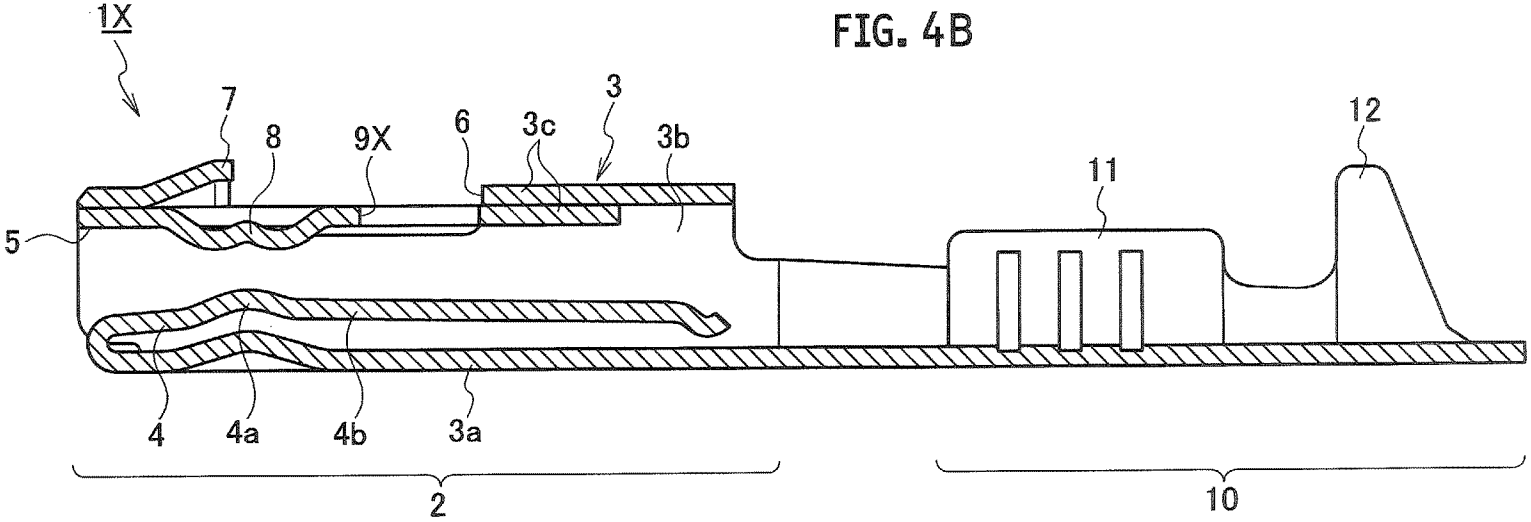
FIG. 4B is a sectional view of the terminal according to the second embodiment.
Figure 5:
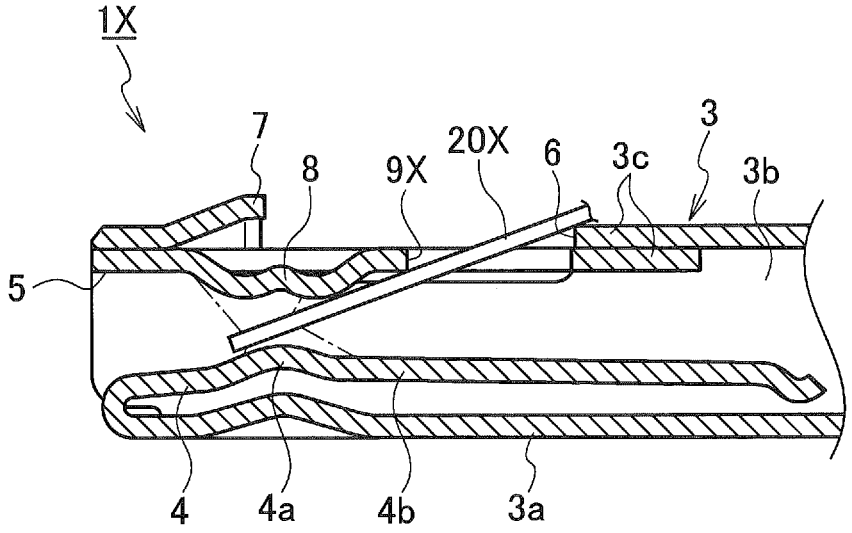
FIG. 5 is a sectional view of an essential part, illustrating a condition that the gold-plating liquid is jetted to a spring contact part and a terminal contact part of the terminal according to the second embodiment.

FIGS. 4 and 5 illustrate a second embodiment. As illustrated in FIG. 4, a terminal 1X according to the second embodiment only differs from the terminal 1 according to the first embodiment in a position of a plating-utility opening 9X and its opening dimension. That is, the plating-utility opening 9X is arranged not in the terminal contact part 8 of the box part 3 facing the spring contact part 4 but in a portion preventing a functional deterioration as the terminal X1 (in this case, which means increasing of the terminal's contact resistance caused by a reduction in its contact area with the partner terminal). Specifically, the plating-utility opening 9X is arranged in a portion of the top wall 3*c*, which is positioned obliquely upward of the indent part 4*a* of the spring contact part 4. Further, the plating-utility opening 9X is provided with the opening dimension larger than the outer diameter size of a nozzle 20X.

As the second embodiment is similar to the first embodiment with respect to the other constitution, constituents identical to those of the first embodiment are indicated with the same reference numerals respectively, and their descriptions are omitted.

As illustrated in FIG. 5, the gold-plating jetting process is accomplished by inserting the nozzle 20X into the box part 3 through the plating-utility opening 9X obliquely and subsequently jetting the gold-plating liquid to the spring contact part 4 including the indent part 4*a* and the terminal contact part 8. If the nozzle 20X has a jet orifice limited approximately to one direction, the nozzle 20X is rotated so as to jet the plating liquid in a desired direction. In this way, it is possible to apply the gold plating treatment to the spring contact part 4 including the indent part 4*a* and the terminal contact part 8 opposed to the spring contact part 4.

The manufacturing procedures of the terminal X1 according to the second embodiment are similar to those of the terminal 1 according to the first embodiment.

Also in the second embodiment, similarly to the first embodiment, the punch-out step and the bending step are executed in the form of sequential pressing steps and thereafter, the plating step as a different kind of step is executed. Therefore, the setting operations for respective steps and the transportations of products among these steps are facilitated in whole, thereby allowing shortening of manufacturing time, reduction of manufacturing cost, etc.

As the plating-utility opening 9X is provided in a portion different from the terminal contact part 8, the contact area with the partner terminal is not reduced, thereby causing no functional deterioration as the terminal 1.

Third Embodiment

Figure 6A:
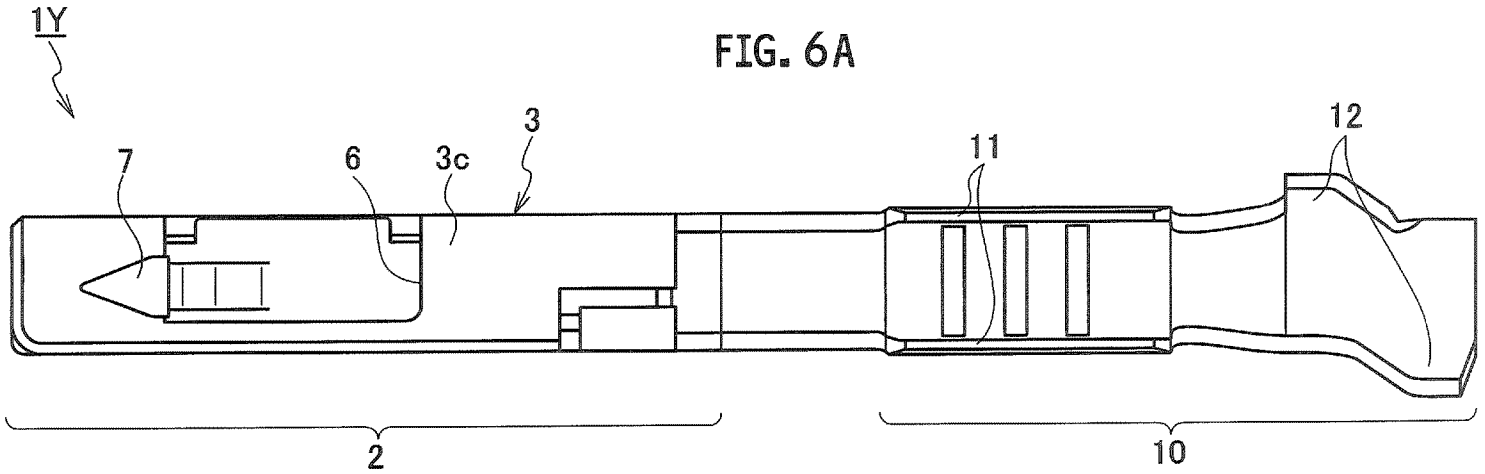
FIG. 6A is a plan view of a terminal according to a third embodiment.
Figure 6B:
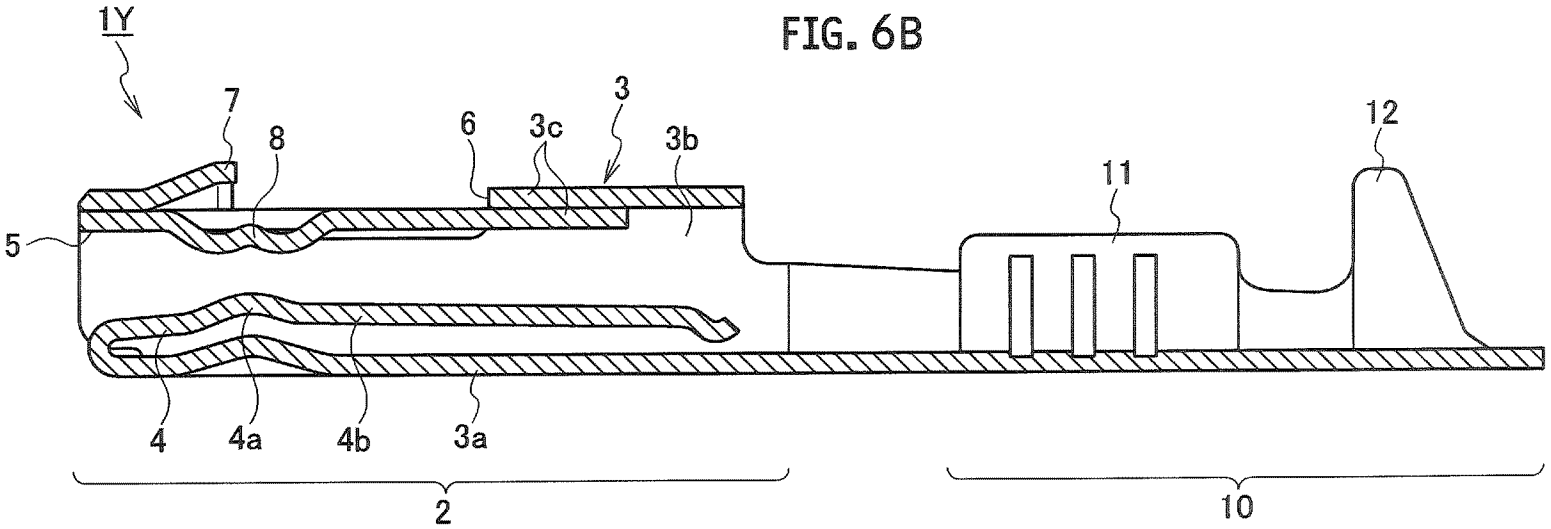
FIG. 6B is a sectional view of the terminal according to the third embodiment.
Figure 7:
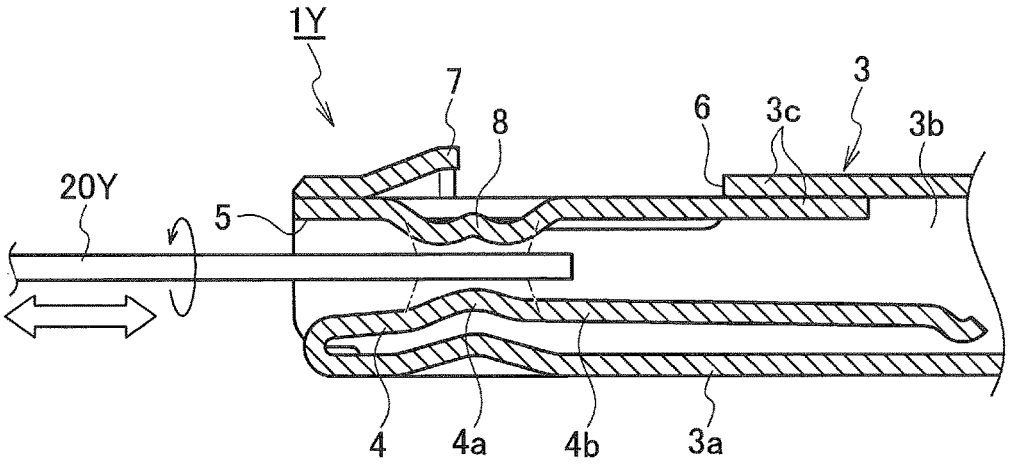
FIG. 7 is a sectional view of an essential part, illustrating a condition that the gold-plating liquid is jetted to a spring contact part and a terminal contact part of the terminal according to the third embodiment.

FIGS. 6 and 7 illustrate a third embodiment. In comparison with the terminals 1, 1X according to the first and second embodiments, as illustrated in FIG. 6, a terminal 1Y according to the third embodiment is provided with neither the plating-utility opening 9 nor the plating-utility opening 9X.

In the third embodiment, constituents similar or identical to those of the first embodiment are indicated with the same reference numerals respectively, and their descriptions are omitted.

Although the manufacturing procedures of the terminal 1Y according to the third embodiment are the same as those of the terminals 1, 1X according to the first and second embodiments, the former differs from the latter only in the method of jetting the gold-plating liquid. That is, as illustrated in FIG. 7, the gold-plating jetting process is attained by allowing a nozzle 20Y to enter the box part 3 through the terminal insertion port 5 for the partner terminal and subsequently allowing the nozzle 20Y to jet the gold-plating liquid, thereby applying the gold plating treatment to the spring contact part 4 including the indent part 4*a* and the terminal contact part 8 opposed to the spring contact part 4.

Also in the terminal 1Y according to the third embodiment, similarly to the terminal 1 according to the first embodiment, the punch-out step and the bending step are executed in the form of sequential pressing steps and thereafter, the plating step as a different kind of step is executed. Therefore, the setting operations for respective steps and the transportations of products among these steps are facilitated in whole, thereby allowing shortening of manufacturing time, reduction of manufacturing cost, etc.

In the terminal 1Y according to the third embodiment, there is no functional deterioration as the terminal 1Y because the plating-utility opening 9 is not provided in the box part 3. Additionally, the strength deterioration of the box part 3 does not occur.

(Modifications)

Although the gold plating treatment is applied to the terminal at the plating step in common with respective embodiments, the invention may be applied to any plating treatment other than the gold plating treatment (e.g. tin plating, silver plating, nickel plating) as long as the plating material is made of a conductive metal.

What is claimed is:

1. A terminal formed by pressing a parent material plate made of a conductive metal to punch out a prescribed shape and bending the plate of the prescribed shape to form the terminal, the terminal comprising:

a box part onto a front surface of which opens a terminal insertion port into which a partner terminal is inserted; and a spring contact part arranged inside the box part, the spring contact part to be contacted to the partner terminal, inserted from the terminal insertion port into the box part, by a flexural returning force, wherein at least the spring contact part inside the box part is plated with a conductive metal by jetting plating liquid inside the box part using a nozzle, a face of the box part is provided with a plating-utility opening, the face facing the spring contact part, and at least the spring contact part is plated by jetting the plating liquid from the nozzle through the plating-utility opening.

2. The terminal of claim 1, wherein the plating-utility opening is arranged in a portion of a terminal contact part provided on the face of the box part, the terminal contact part to be contacted to the partner terminal which is inserted from the terminal insertion port into the box part, the portion facing the spring contact part.

3. The terminal of claim 1, wherein the plating-utility opening is arranged in a portion on the face of the box part, the portion being different from a terminal contact part provided on the face of the box part, the terminal contact part to be contacted to the partner terminal which is inserted from the terminal insertion port into the box part.

* * * * *